US005819340A

United States Patent [19]

Kelly

[11] Patent Number: 5,819,340

[45] Date of Patent: Oct. 13, 1998

[54] INFANT SLEEPER

[76] Inventor: Jim E. Kelly, 2274 W. 21st St., Los Angeles, Calif. 90018

[21] Appl. No.: 929,626

[22] Filed: Sep. 15, 1997

[51] Int. Cl.[6] ..... A47D 7/04

[52] U.S. Cl. ..... 5/95; 5/93.1

[58] Field of Search ..... 5/93.1, 95, 96, 5/98.1, 98.3, 99.1, 100

[56] References Cited

U.S. PATENT DOCUMENTS

| | | | |
|---|---|---|---|
| Re. 13,719 | 4/1914 | Taylor . | |
| 134,847 | 1/1873 | Bryan . | |
| 328,157 | 10/1885 | Tyler . | |
| 412,107 | 10/1889 | Stoy . | |
| 620,067 | 2/1899 | Wright . | |
| 884,509 | 4/1908 | Lindsey . | |
| 909,113 | 1/1909 | Philia et al. | 5/101 |
| 920,009 | 4/1909 | Beeland . | |
| 928,621 | 7/1909 | Taylor | 5/99.1 |
| 1,138,451 | 5/1915 | Bugele . | |
| 1,267,244 | 5/1918 | McMillan . | |
| 1,495,988 | 6/1924 | Catino . | |
| 1,574,226 | 2/1926 | Ackermann . | |
| 1,762,680 | 6/1930 | Debelack . | |
| 1,897,258 | 2/1933 | Jenne . | |
| 2,475,775 | 7/1949 | Boren . | |
| 2,507,060 | 5/1950 | Surface | 5/96 |
| 2,537,539 | 1/1951 | McLendon et al. . | |
| 2,569,555 | 10/1951 | Chanslor et al. . | |
| 2,688,997 | 9/1954 | Miller . | |
| 3,321,779 | 5/1967 | Kaufman et al. . | |
| 3,400,829 | 9/1968 | Youngson . | |
| 3,631,547 | 1/1972 | Massie . | |
| 3,803,646 | 4/1974 | Newerowski . | |
| 3,840,924 | 10/1974 | Hamilton . | |
| 3,854,156 | 12/1974 | Williams . | |
| 3,856,276 | 12/1974 | Pannell . | |
| 4,123,809 | 11/1978 | Pugh . | |
| 4,788,726 | 12/1988 | Rafalko . | |
| 5,148,561 | 9/1992 | Tharalson et al. . | |
| 5,293,655 | 3/1994 | Van Winkle et al. . | |

*Primary Examiner*—Michael F. Trettel
*Attorney, Agent, or Firm*—Blakely, Sokoloff, Taylor & Zafman LLP

[57] ABSTRACT

A crib for newborns and infants is easily placed in close proximity to the parents' bed without being physically attached thereto. An otherwise conventional crib mattress is retained in a bassinet or similar structure. The bassinet is supported in a frame that partially slides under the parents' bed, thereby allowing the bassinet to extend partially over the top surface of the parents' mattress.

12 Claims, 3 Drawing Sheets

INFANT SLEEPER

BACKGROUND OF THE INVENTION

1. Field of the Invention

The present invention relates generally to the field of beds and particularly to a crib for newborns and infants that can be placed in close proximity to the parents' bed.

2. Background

It is common practice for newborns and infants to sleep in cribs. The crib may be located in the parents' bedroom or in a separate nursery. Child-care experts suggest that children should be trained at a very early age to sleep alone and, therefore, the child should be physically removed from the parents at night. However, many dispute this theory and believe that young children should sleep with their parents, at least until weaned. But, if the child is allowed to sleep in the parents' bed, there is a risk of physical injury or suffocation.

Conventional cribs, even if placed in the parents' bedroom keep the child physically separated from the parents. At best, the crib can only be brought adjacent to the bed, and even then the child will likely be separated from its parents by a panel of bars.

One solution has been a crib that physically attaches to the parents bed. Examples of this are shown in U.S. Pat. Nos. 134,847; 328,157; 413,107; 484,975; 884,509; 920,009; 1,138,451; 1,267,244; 1,495,988; 5,148,561 and 5,293,655. Each of these prior art cribs is more or less permanently attached to the parents' bed and cannot be easily relocated. Moreover, in each of these designs, the crib is not self-supporting, but instead depends upon at least partial support by the frame of the parents' bed.

SUMMARY OF THE INVENTION

The present invention overcomes the disadvantages of the prior art by providing a free-standing crib that can be brought into close proximity to the parents' bed and can extend at least partially thereover. The invention comprises an otherwise conventional crib mattress; a mattress retainer having an essentially flat-bottom surface and a peripheral wall at least partially surrounding the mattress; means for supporting the mattress retainer; a pair of generally upright supports coupled to the mattress retainer supporting means; a pair of generally horizontal base supports, each coupled to a respective one of the generally upright supports, said base supports extending transversely below the mattress retainer supporting means and having first and second ends; a pair of diagonal supports, each extending between an upper portion of a respective generally upright support and the first end of the respective base support; wherein the mattress retainer extends substantially beyond the generally upright supports in a transverse direction toward the second ends of the base supports.

In use, the base supports are positioned with the second ends extending under the parents' bed with the upright supports adjacent to the parents' mattress. This allows the mattress and mattress retainer to extend partially over the top surface of the parents' mattress.

When it is desired to relocate the crib, it can be simply drawn away from the parents' bed since it is entirely self-supporting. The mattress retainer may be in the form of a portable bassinet that can be readily removed from the mattress retainer supporting means.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
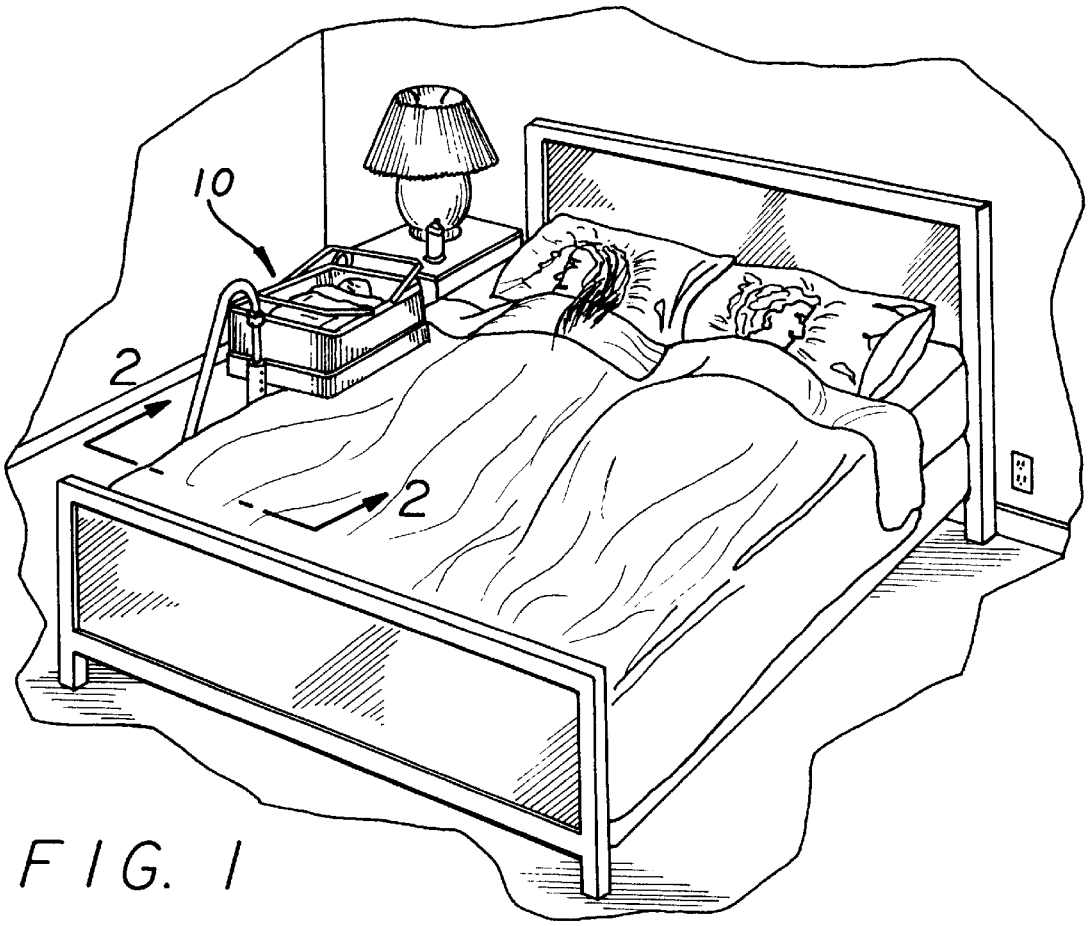
FIG. 1 is perspective view illustrating a crib constructed in accordance with the present invention positioned adjacent to the parents' bed.

An infant bed or crib 10 constructed in accordance with the present invention is shown generally in FIG. 1. As can be seen, the infant sleeping in crib 10 is easily accessible from the parents' bed in the event that the infant awakens.

Figure 2:
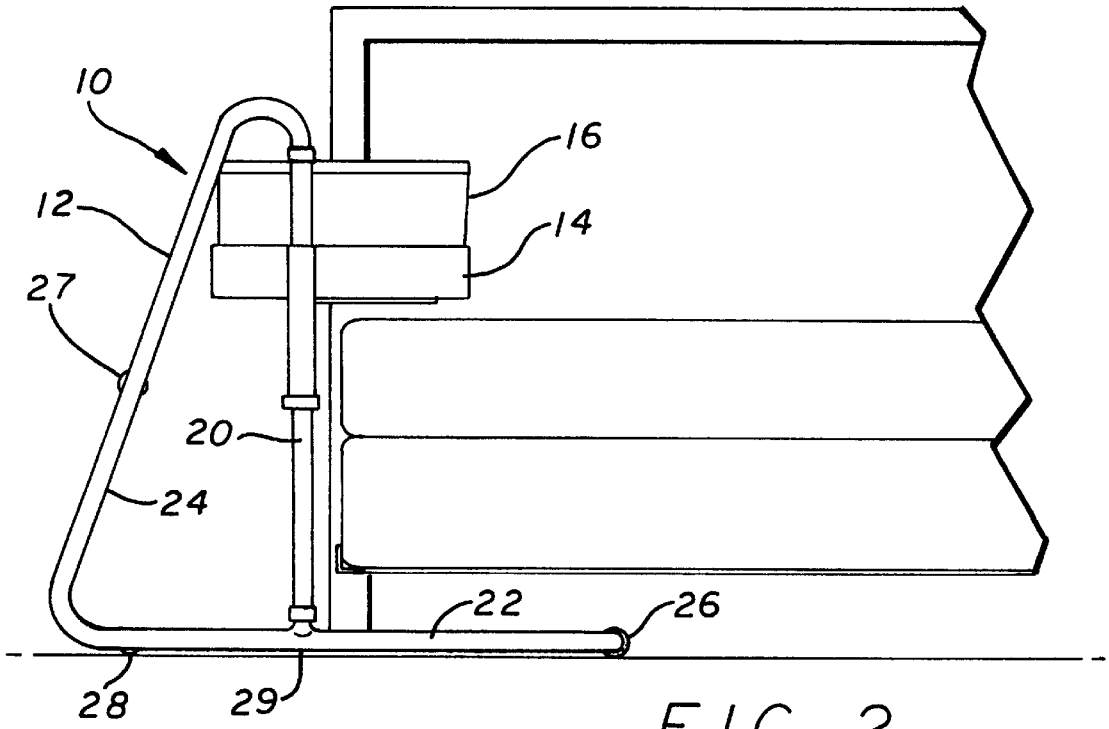
FIG. 2 is an end elevation view of the crib of FIG. 1.

Referring now to FIG. 2, crib 10 comprises a frame 12, a shelf 14 and a mattress retainer 16. Frame 12 is preferably constructed of a plastic material, such as PVC pipe, although other suitable materials may be employed. As seen in FIG. 2, the principal components of frame 12 are upright member 20, base member 22 and diagonal support member 24. As will be apparent from the discussion that follows, frame 12 supports one side of crib 10, there being a substantially identical frame 12' on the opposite side.

To place crib 10 in its preferred position relative to the parents' bed, base member 22 is slid under the bed until upright member 20 is immediately adjacent to the edge of the bed. In this position, shelf 14 and mattress retainer 16 extend over the top surface of the parents' bed so that the child is in intimate proximity with its parents. Since there is no physical attachment between crib 10 and the parents' bed, the crib can be easily relocated when desired, such as when the child naps during the day.

Figure 3:
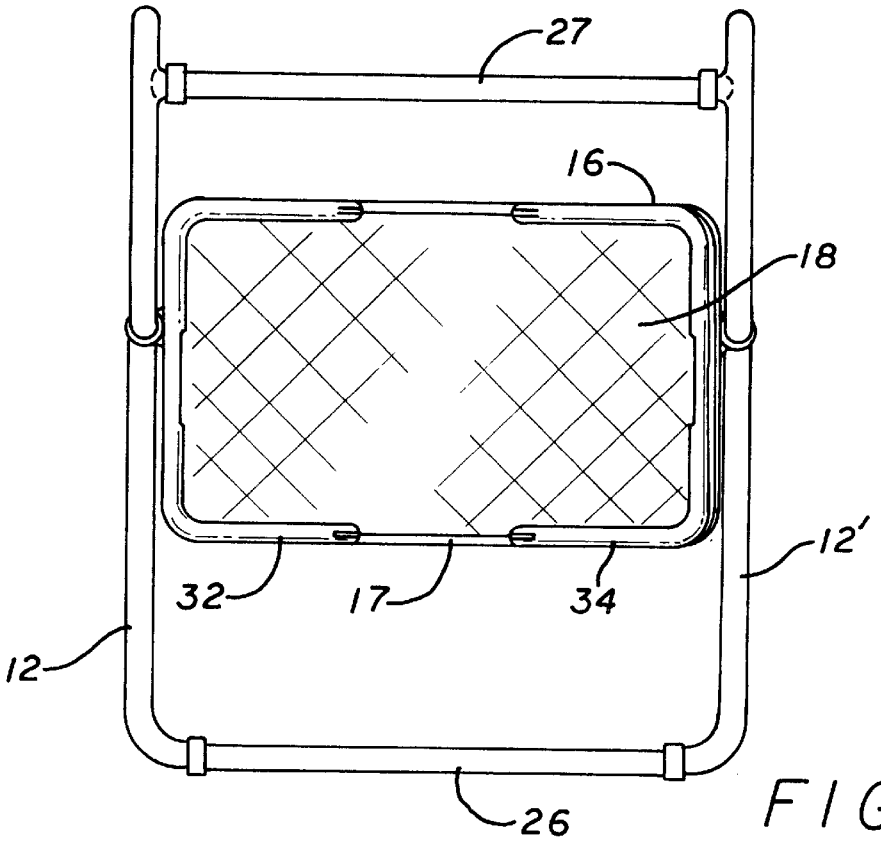
FIG. 3 is a top plan view of the crib of FIG. 1.

A top plan view of crib 10 is shown in FIG. 3. Side frames 12 and 12' are joined by transverse interconnection members 26 and 27. Additional transverse interconnection members 28 and 29 are hidden from view in this figure. In a preferred embodiment, mattress retainer 16 is a generally rectangular, tub-like bassinet, which may be provided as a component part of the crib set or may be separately available. In either case, the bassinet is preferably removable from the crib. The bassinet preferably has a pair of folding handles 32, 34 with which the bassinet can be conveniently carried when removed from crib 10.

Bassinet 16 is surrounded by a peripheral wall 17 to retain mattress 18. If desired, this wall may be cut-out or partially eliminated on the side facing the parents' bed so that the child will be more easily accessible. Of course, suitable means must then be provided to prevent the child from falling out of the bassinet if it is removed from crib 10 or if crib 10 is relocated away from the parents' bed.

Figure 4:
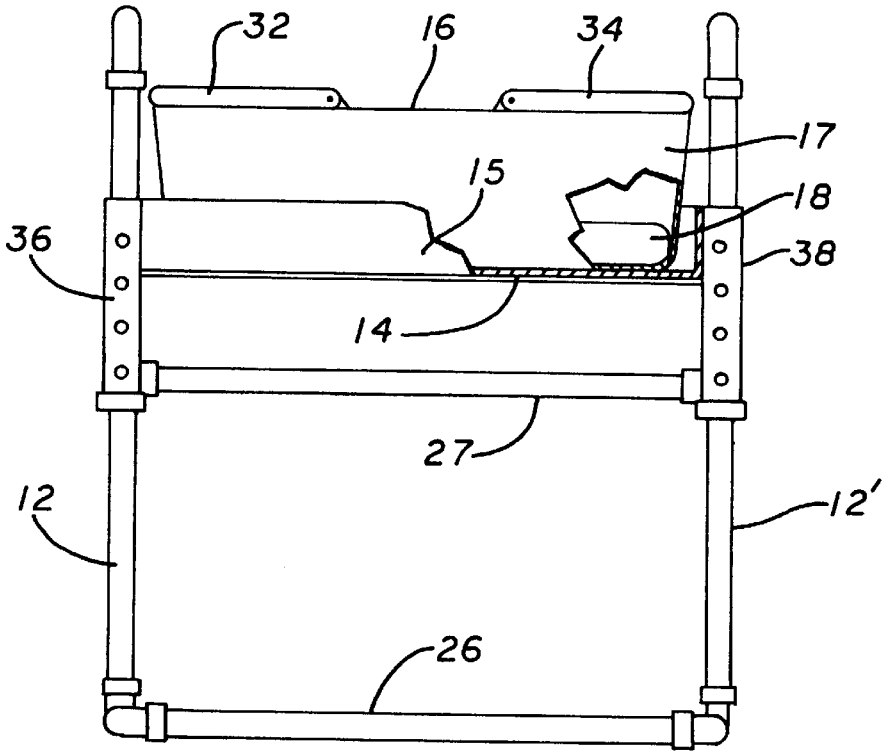
FIG. 4 is a side elevation view of the crib of FIG. 1.

As best seen in FIG. 4, mattress retainer/bassinet 16 is normally supported in crib 10 by shelf 14. Shelf 14 is bonded or otherwise suitably attached to height adjustment members 36, 38. These adjustment members are generally cylindrical in shape and slide over upright supports 20 and 20', respectively. Alternative means for supporting mattress retainer/bassinet 16 may be employed. For example, the bassinet may be self-supporting across its bottom surface and may be secured at the head and foot ends to side frames 12 and 12' with suitable brackets. As another example, the bassinet may be suspended by handles 32, 34 or other means from the side frames 12 and 12'. This alternative would allow the bassinet to be rocked, if desired.

Shelf 14 is surrounded by a shallow lip 15 which serves to retain the bassinet 16 laterally. Clamps or other positive locking means may be provided to secure the bassinet to the tray so that it cannot be inadvertently dislodged.

Figure 5:
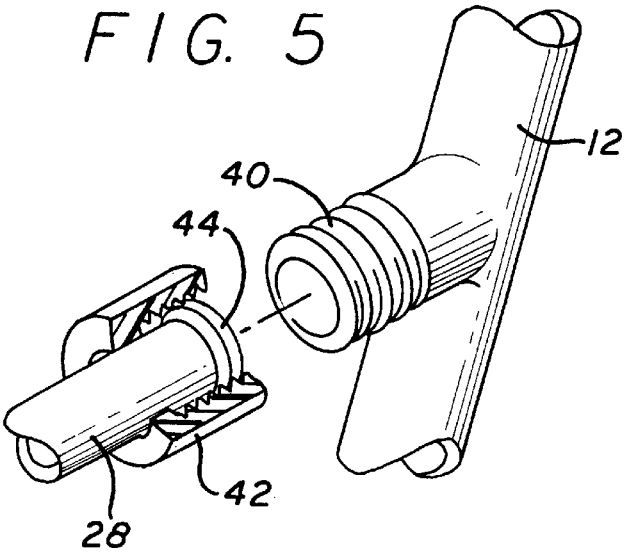
FIG. 5 is a detailed view of a connector used in a preferred embodiment of the present invention.

Details of the attachment of transverse interconnection members 26–29 to side frames 12 and 12' are shown in FIG. 5. Side frames 12 and 12' have threaded nipples 40 bonded thereto at appropriate locations. Each end of the transverse interconnection members is fitted with a threaded collar 42, which is retained by a flange 44. The frame of crib 10 is easily assembled by threading each of collars 42 onto the corresponding nipples 40. This facilitates shipping and storage of crib 10.

Figure 6:
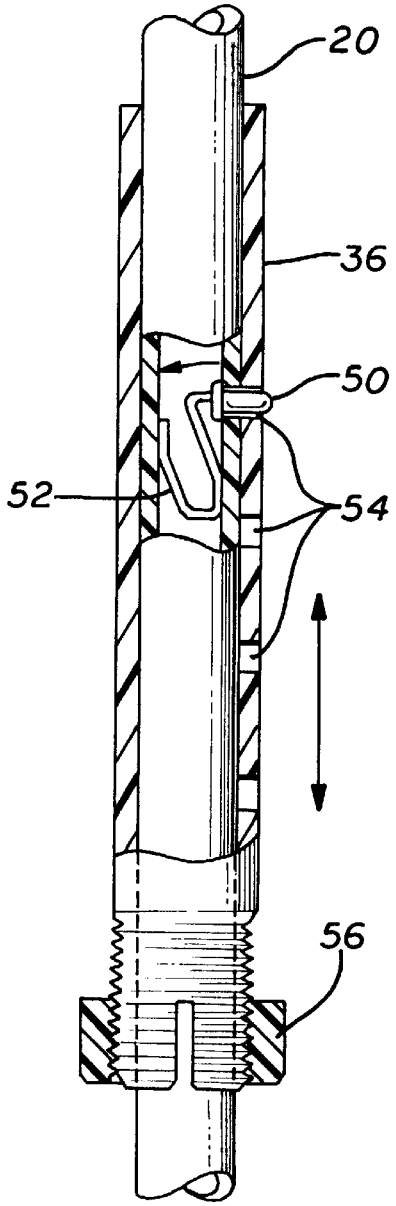
FIG. 6 is a cross-sectional view along line 6—6 of FIG. 4 illustrating the height adjustment mechanism of the present invention.

FIG. 6 shows details of the height adjustment mechanism. Each of upright support members 20 and 20' is fitted with a push-button 50 which is loaded by spring 52. Adjustment members 36 and 38 each have a plurality of holes 54 which may be engaged by push-button 50. To adjust the height of shelf 14, push-buttons 50 are depressed and the adjustment members 36, 38 are moved to the desired vertical position at which push-button 50 engages one of holes 54. In order to more securely lock shelf 14 into position, adjustment members 36, 38 are notched and threaded at their lower ends. A threaded collar 56 is provided at the bottom of each of adjustment members 36, 38. Once shelf 14 has been placed in the desired vertical position, collars 56 are tightened to clamp the adjustment members to their respective vertical supports.

Figure 7:
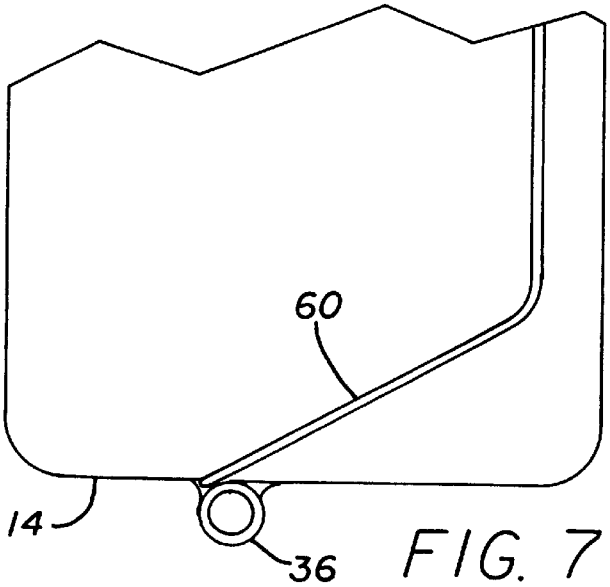
FIG. 7 is a partial bottom plan view of the crib shelf of the present invention.
Figure 8:
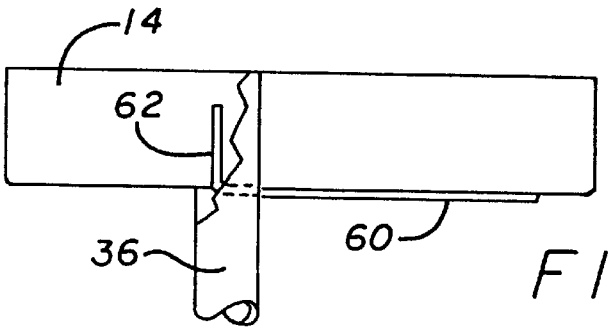
FIG. 8 is a partially cut away detailed side view of the crib shelf.

Referring to FIGS. 7 and 8, shelf 14 is reinforced with supporting rod 60, which may be formed of mild steel or other suitable material. Rod 60 may be either bonded to the underside of shelf 14 or may be molded in. In either case, ends 62 of rod 60 are bent upwardly and are bonded or molded into the fillet between shelf 14 and adjustment members 36, 38.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A crib for an infant comprising:

a mattress;

a mattress retainer having a substantially flat bottom surface and a peripheral wall at least partially surrounding the mattress;

means for supporting the mattress retainer;

a pair of generally upright supports coupled to the mattress retainer supporting means;

a pair of generally horizontal base supports, each coupled to a respective one of the generally upright supports, said base supports extending transversely below the mattress retainer supporting means and having first and second ends;

a pair of diagonal supports, each extending between an upper portion of a respective generally upright support and the first end of the respective base support;

wherein the mattress retainer extends substantially beyond the generally upright supports in a transverse direction toward the second ends of the base supports.

2. The crib of claim 1 wherein the mattress retainer is removably coupled to the mattress retainer supporting means.

3. The crib of claim 1 wherein the mattress retainer comprises a bassinet.

4. The crib of claim 3 wherein the bassinet includes a handle.

5. The crib of claim 1 wherein the mattress retainer supporting means comprises a shelf.

6. The crib of claim 1 further comprising means for adjusting the height of the mattress retainer supporting means on the upright supports.

7. A crib for an infant comprising:

a mattress;

means for supporting the mattress;

a frame coupled to the mattress supporting means, said frame supporting the mattress above a floor level such that the crib can be positioned adjacent to a bed without being attached thereto with the mattress extending at least partially over a top surface of the bed, said frame comprising at least one generally upright support coupled to the mattress supporting means, at least one generally horizontal base support and at least one diagonal support coupled between the upright support and the base support.

8. The crib of claim 7 wherein the mattress supporting means is removably coupled to the frame.

9. The crib of claim 7 wherein the mattress supporting means comprises a bassinet.

10. The crib of claim 9 wherein the bassinet includes a handle.

11. The crib of claim 7 wherein the mattress supporting means comprises a shelf.

12. The crib of claim 7 further comprising means for adjusting the height of the mattress supporting means.

* * * * *